United States Patent [19]

Brackmann

[11] Patent Number: 4,512,353

[45] Date of Patent: Apr. 23, 1985

[54] TOBACCO DRYING PROCEDURE

[75] Inventor: Warren A. Brackmann, Mississauga, Canada

[73] Assignee: Rothmans of Pall Mall Canada Limited, Don Mills, Canada

[21] Appl. No.: 466,792

[22] Filed: Feb. 16, 1983

[30] Foreign Application Priority Data

Mar. 2, 1982 [GB] United Kingdom ..... 8206083

[51] Int. Cl.[3] ..... A24B 3/10; A24B 3/18

[52] U.S. Cl. ..... 131/304; 131/305; 34/46; 34/34

[58] Field of Search ..... 131/304, 302, 303, 305; 34/34, 46, 48, 50

[56] References Cited

U.S. PATENT DOCUMENTS

| | | | |
|---|---|---|---|
| 716,646 | 12/1902 | Reber | 131/304 |
| 3,386,448 | 6/1968 | Wochnowski | 131/303 |
| 3,389,707 | 6/1968 | Wochnowski | 131/303 |
| 3,429,317 | 2/1969 | Koch et al. | 131/303 |
| 4,044,780 | 8/1977 | Kelly | 131/303 |
| 4,407,306 | 10/1983 | Hibbitts | 131/304 |

*Primary Examiner*—V. Millin
*Assistant Examiner*—H. Macey
*Attorney, Agent, or Firm*—Sim & McBurney

[57] ABSTRACT

Drying of tobacco particles in heated rotary drum drier is improved by flowing air through the drum at a flow rate, usually at least 10 ft./sec. (3.25 m/sec), which imparts translational or linear motion to the particles. The translational motion causes the particles to become classified based on size and weight and thereby to cause smaller particles to pass through the drum at a faster rate than larger particles. In this way, smaller particles are less exposed to the drying heat than larger ones, so that overdrying of small particles is avoided and overall filling power is improved.

7 Claims, No Drawings

TOBACCO DRYING PROCEDURE

FIELD OF INVENTION

The present invention relates to the drying of tobacco.

BACKGROUND TO THE INVENTION

In conventional tobacco drying procedures, cut tobacco is positioned in a rotating heated drum and air is passed through the drum to remove moisture. The drum is mounted with its axis extending a few degrees above horizontal, so that the tobacco passes under the influence of gravity from the higher end to the lower end as the drum rotates about its axis and the tobacco tumbles in the flowing air stream. A typical arrangement is described in U.S. Pat. No. 3,372,488.

The tobacco which is dried in this way has various particle sizes and is dried to an average moisture content. Upon examination of the individual particles resulting from such prior art drying process, it has been found that smaller tobacco particles contain much less than the average moisture content of the tobacco while larger tobacco particles contain more than the average moisture content of the tobacco.

The significantly less moisture content of the small particles renders them brittle and subject to abnormal breakage as they tumble in the drier, thereby impairing their filling power, so that overall, the filling power of the tobacco is impaired by the conventional drying procedure.

This problem is particularly acute when drying shredded stem material produced by the process described in U.S. patent application Ser. No. 244,083 filed Mar. 16, 1981, now U.S. Pat. No. 4,386,617, in the names of Warren A. Backmann et al and assigned to the assignee herein, because the product contains a significantly higher proportion of fine strands than in conventional shredded lamina material.

The aforesaid U.S. patent application describes the shredding of tobacco stem material by thoroughly soaking the stems in water to a moisture content of about 30 to about 60 wt%, fiberizing the soaked stems between counter-rotating ribbed discs spaced apart about 0.05 to about 0.30 inches, and subsequently drying the shredded stem material to a moisture content of about 10 to about 16 wt%. The disclosure of U.S. Ser. No. 244,083, now U.S. Pat. No. 4,386,617, is incorporated herein by reference.

SUMMARY OF INVENTION

The present invention provides an improvement in a method of drying particulate tobacco material by passing particulate tobacco material to be dried from one end of a heated drying zone to the other, heating the particulate tobacco material during its passage through the drying zone, and contacting the heated particulate tobacco material with an air stream flowing through the drying zone to remove moisture from the heated particulate tobacco material.

The improvement of the present invention comprises flowing the air stream in the direction of movement of the particulate tobacco material through the drying zone at a rate such that the air imparts a translational or linear motion to the particulate tobacco material in the drying zone and the speed of individual tobacco particles through the drying zone is proportional to the size of the individual tobacco particle.

GENERAL DESCRIPTION OF INVENTION

In the present invention, the degree of drying of individual tobacco particles is controlled depending on the particle size, in order to decrease the difference between the moisture content of both the smaller and larger particles with reference to the average moisture content. In this way, the filling power of the smaller particles is much less impaired than in the conventional drying procedure and hence the overall filling power of the tobacco is improved.

In the present invention, the heated drying zone preferably comprises a heated rotating drum. In this preferred embodiment of the invention, tobacco particles are heated in a rotating drum to effect drying of the same while air is passed axially through the drum at a velocity which is at least sufficient to effect classification of the tobacco particles in the drum in accordance with the size of the particles.

As the tobacco particles tumble in the air flow as a result of the drum rotation, the velocity of flow of air in this invention causes translational motion of the tobacco particles to occur, the smallest and lightest particles being carried the farthest distance and the largest and heaviest particles being carried the shortest distance. In this way, the residence time of the particles in the heated drum, and hence the exposure to heat, depends on their particle size.

Smaller particles lose their moisture faster than larger particles and hence the lesser residence time for the smaller particles as compared with the larger particles leads to a moisture loss from each size particle which is preferably approximately the same and at least is less for smaller particles than the prior art and is greater for larger particles than the prior art. In this way, the moisture content of the individual tobacco particles preferably approximates that of the average moisture content.

The flow rate of air which is used in the prior art procedure for removal of moisture from cut lamina material typically does not exceed 6 ft./sec. (2 m/sec). The flow rate is designed only to remove moisture and is insufficient to impart a significant component of linear motion to the particles.

In contrast, in the present invention, the flow rate of air through the drier drum for the drying of cut lamina material is at least sufficient to impart a component of linear motion to the tobacco particles, and usually is at least 10 ft.sec. (3.25 m/sec). This linear motion results in classification of the particles by weight and ensures that the particles are subjected to more ideal drying conditions than has heretofore been the case.

The invention is particularly useful in controlling the drying of shredded stem material. The larger proportion of finer strands present in this tobacco material, when compared with shredded lamina material, results in a greater impairment to filling power as a result of overdrying of these finer strands, when conventional drying is employed, than is the case with cut lamina material. By controlling the flow rate of the air sufficiently to impart translational or linear motion to the shredded stem particles and thereby to effect classification of particles based on their size and weight, the overdrying of finer strands, and consequent impairment of filling power of the shredded stem material, is avoided.

As noted above, gravitational forces are largely responsible for achieving movement of the particles through the rotating drum from the higher end to the lower end and this movement is augmented in this invention by the velocity of flow of air through the rotary drum. The overall moisture content of the shredded tobacco material may be varied by varying the overall flow rate through the drum by varying the speed of rotation of the drum and the angle of the drum to the horizontal and by varying the temperature to which the drum is heated.

SUMMARY OF DISCLOSURE

In summary of this disclosure, the present invention provides an improved drying procedure for cut tobacco and shredded stem material to prevent overdrying of smaller sized particles and thereby improve the filling power of the dried tobacco product. Modifications are possible within the scope of this invention.

What I claim is:

1. In a method of drying particulate tobacco material by passing particulate tobacco material to be dried from one end of a heated drying zone to the other, heating said particulate tobacco material during its passage through the drying zone, and contacting said heated particulate tobacco material with an air stream flowing through said drying zone to remove moisture from the heated particulate tobacco material, the improvement which comprises flowing said air stream in the direction of movement of the particulate tobacco material through the entire drying zone at a rate such that the air imparts a translational motion to the particulate tobacco material in the entire drying zone and the speed of individual tobacco particles through the entire drying zone is proportional to the size of the individual tobacco particle.

2. The method of claim 1, wherein said particulate tobacco material is cut tobacco lamina material.

3. The method of claim 1, wherein said particulate tobacco material is shredded tobacco stem material.

4. A method of drying particulate tobacco, which comprises:

heating said particulate tobacco in a rotary cylindrical drum mounted inclined upwardly a few degrees to the horizontal towards the upstream end of the drum, rotating the particulate tobacco in the drum to cause the same to tumble and move towards the downstream end of the drum under the influence of gravity, and passing air through the drum from the upstream end to the downstream end of the drum to engage the tumbling particulate tobacco to remove moisture therefrom, said air being passed through the entire drum at a flow rate at least sufficient to effect classification of the particulate tobacco throughout the entire drum into fractions having differing weights.

5. The method of claim 4 wherein said particulate tobacco is cut tobacco lamina material.

6. The method of claim 4 wherein said particulate tobacco is shredded tobacco stem material.

7. The method of claim 4 wherein the overall flow rate of said particulate tobacco through the drum is controlled by varying the speed of rotation of the drum and the angle of the drum to the horizontal.

* * * * *